United States Patent [19]

Bienvenu

[11] 4,428,894

[45] Jan. 31, 1984

[54] METHOD OF PRODUCTION OF METALLIC GRANULES, PRODUCTS OBTAINED AND A DEVICE FOR THE APPLICATION OF THE SAID METHOD

[75] Inventor: Gérard Bienvenu, Annemasse, France

[73] Assignee: Extramet, Annemasse, France

[21] Appl. No.: 296,270

[22] PCT Filed: Dec. 22, 1980

[86] PCT No.: PCT/FR80/00187

§ 371 Date: Aug. 21, 1981

§ 102(e) Date: Aug. 21, 1981

[87] PCT Pub. No.: WO81/01811

PCT Pub. Date: Jul. 9, 1981

[30] Foreign Application Priority Data

Dec. 21, 1979 [FR] France ..... 79 32115

[51] Int. Cl.[3] ..... B22F 9/08

[52] U.S. Cl. ..... 264/9; 425/6

[58] Field of Search ..... 264/9; 425/6

[56] References Cited

U.S. PATENT DOCUMENTS 2,287,029 6/1942 Dowdell ..... 264/13
2,510,574 6/1950 Greenhalgh ..... 264/9
4,216,178 8/1980 Anderson ..... 264/9

FOREIGN PATENT DOCUMENTS 2408414 11/1978 France .
572400 10/1945 United Kingdom .
952457 3/1964 United Kingdom .

OTHER PUBLICATIONS

Anderson, Chem. Abstr., vol. 89, 11459/m, 1978, p. 322.

*Primary Examiner*—Maurice J. Welsh
*Attorney, Agent, or Firm*—Sprung, Horn, Kramer & woods

[57] ABSTRACT

Metal in the form of granules is solidified from the molten state by forming a jet of molten metal which is caused to pass through a vibrating orifice in order to divide the jet into individual drops and causing solidification of the drops by cooling so as to form the granules. The drops of the jet are caused to fall from the vibrating orifice under the action of gravity through an inert gas atmosphere which is maintained at a temperature below the solidification temperature of the molten metal. In the case of reactive metals, the jet is formed by withdrawal from a mass of molten metal maintained in contact with a bath which is not miscible with the molten mass and selectively dissolves the derivatives produced in the event of oxidation.

12 Claims, 3 Drawing Figures

METHOD OF PRODUCTION OF METALLIC GRANULES, PRODUCTS OBTAINED AND A DEVICE FOR THE APPLICATION OF THE SAID METHOD

The present invention relates to the production of metallic particles or granules. The invention is primarily directed to a method of production of metallic granules and extend to the products obtained in accordance with said method as well as to a device which is particularly well suited to the practical application of said method.

The invention is of general utility for the conversion of any metal into granules, this conversion principle being applicable not only to pure or practically pure metals but also to metallic compounds or alloys. The general aim of the invention is to obtain practically spherical grains having a diameter of the order of 0.1 to 5 mm, for example, thus forming in the aggregate a powder which has good flow capability, which can readily be conveyed by pneumatic means, which has relatively high bulk density and low porosity while also providing the possibility of obtaining uniform calibration of grains, if necessary after a sorting operation which is readily performed.

To this end, a molten metal bath must necessarily be employed at the outset. But the properties of metals, first in the liquid state, then during transition from the liquid to the solid state, and finally in the solid state, represent specific conditions such that the methods of granulation commonly employed in the treatment of products of another type such as products in paste form cannot be applied to these latter in a general manner. Furthermore, the methods of production of granules from molten metal baths which have been in use up to the present time do not yet prove satisfactory from the point of view of regularity of shapes and dimensions. In regard to methods related to the atomization process which it has been sought to apply to products having a base of reactive metals such as calcium, these methods produce reactive and hygroscopic powders which have poor storage stability and finally offer limited possibilities of use.

In order to overcome these disadvantages, the invention proposes a method of production of metallic granules of the type in which metal in the form of granules is solidified from the molten state. The method essentially consists in forming a jet of molten metal which is caused to pass through a vibrating orifice in order to divide the jet into individual drops and finally in causing solidification of said drops by cooling so as to form granules.

The method in accordance with the invention can be applied to the production of metallic granules from molten metal baths having any composition. However, it will be observed that, in the majority of instances, the metals being processed are in the molten state at a temperature within the range of 200° to 1500° C. and that the vibrating orifice through which the jet of molten metal is discharged usually opens into an atmosphere which is cooled by dissipation of heat in the surrounding air, the temperature of which can therefore be within the range of 20° to 90° C., for example. In practice, the operation is advantageously performed under conditions such that the temperature difference between the molten metal at the point of formation of the jet and the atmosphere into which the vibrating orifice opens is at least of the order of 200° C. and preferably within the range of 300° to 1300° C., and more particularly within the range of 500° to 1000° C.

In accordance with a preferred mode of execution of the invention, the drops of the jet are caused to fall from the vibrating orifice under the action of gravity through an atmosphere of inert gas which is maintained at a temperature below the solidification temperature of the molten metal. The inert gas atmosphere may be chosen as a function of the nature of the metal, of the jet diameter and of the pressure conditions at the level of the vibrating orifice so as to ensure that the drops thus formed rapidly attain the maximum rate of fall over a height of fall which is made available in the atmosphere and is sufficient to permit complete solidification of the granules prior to collection. In practice, the rate of fall can be of the order of 2 to 30 meters per second, for example. Depending on the thermal conditions, solidification may require a length of time corresponding to a height of fall of the order of 10 cm to 20 m or preferably 20 cm to 10 m. During solidification or at least at the beginning of solidification, the metal drops are subjected to internal stresses which result from the vibrations imparted at the moment of division of the jet into drops at the exit of the vibrating orifice. The invention thus makes it possible to obtain granular powders in which the diameters of the granules can be of the order of 0.2 to 3 mm, for example, with dispersions with respect to the mean dimension which can remain less than ±0.5 mm or may even not exceed approximately ±0.01 mm.

In conjunction with the cooling conditions applied, the powders obtained also have surface qualities which are usually conducive to the properties sought in this type of granular product, especially a degree of surface hardness and strength which are conducive to good storage stability as well as flowability of the powder. By way of example, the inert gas can be helium, argon or mixtures of these gases. In some cases, it may prove advantageous to carry out in addition a dispersion of the metallic drops during solidification with respect to the direction of fall of the jet in order to prevent individual drops from coalescing during solidification.

In accordance with another distinctive feature of the invention, arrangements may be made to form the liquid metal jet by withdrawal from a mass of molten metal maintained in contact with a bath which is not miscible with said mass and selectively dissolves the derivatives produced in the event of oxidation. The metal can advantageously be melted, passed in the molten state through the bath for selective dissolution of the oxidation derivatives and then separated from the bath by settling so as to constitute the mass from which the jet is drawn. Steps can also be taken to ensure that the molten metal is then conveyed without any further contact with air or an oxidizing atmosphere up to the point of discharge of the jet into an inert cooling atmosphere as described earlier, preferably by means of a section of vertical piping which terminates in the vibrating orifice. In a particularly advantageous mode of execution of the method according to the invention, the mass of molten metal can be forced through a filter for retaining solid particles, said filter being maintained immersed in the bath for dissolution of solid derivatives, said mass being then separated from said bath by settling prior to formation of the jet.

In accordance with the invention, it is thus possible to treat reputedly reactive metals while readily circumventing all the potential difficulties arising from the presence of solid oxidation derivatives which would otherwise be liable to obstruct the holes of the filter or the jet discharge orifice and thus produce an irregularity in the formation of drops. The bath employed can advantageously consist of a fused halide of at least one metal of the molten metal mass. Said bath can also consist of a fused halide of at least one additional metal which has higher reducing power than the essential metal of the granules and is incorporated in said mass in a small proportion. An additional metal of this type can consist in particular of calcium, the oxide of this metal being readily dissolved in a bath of calcium fluoride and/or chloride. A proportion of calcium of the order of 0.5 to 10% by weight is usually sufficient in metals such as aluminium or magnesium, for example. A point to be noted is that the additional metal can be present in the granules obtained in accordance with the invention whereas the recommended conditions of execution are such that molten salts can be prevented from being present in any proportion other than that of trace constituents which are detectable but not objectionable. In particular, the invention makes it possible to produce granules of reactive metals such as calcium, magnesium or aluminium which, in spite of the use of a bath of fused salts, do not have any hygroscopic character which would be liable to impair storage stability and flowability of the powders.

The production of metallic granules in accordance with the method contemplated by the invention involves the use of a device comprising a furnace for melting metal within a vessel designed to receive a mass of molten metal, means for forming a jet of metal withdrawn from said mass and passed through a vibrating orifice, means for causing vibration of said orifice and thus dividing the jet into individual drops, and a chamber for subjecting the metal discharged from said orifice to cooling and solidification over at least the distance of downward travel of the drops during their solidification. Preferably, the device comprises a siphon for withdrawing metal from a mass of molten metal separated from a bath of fused salts by settling within said vessel. As an advantageous feature, the device can also comprise a filter having holes smaller in size than the vibrating orifice or having a maximum size equal to said orifice, and means for forcing the molten metal through said filter which is immersed in the bath of fused salts. Furthermore, said vessel and said cooling chamber are preferably gas-tight and means are advantageously provided for separately adjusting the pressure of an inert gas within said vessel and within said cooling chamber.

Further distinctive features of the invention will become apparent from the following description and in particular from the more detailed description of a device for the production of metallic granules, reference being made to the accompanying drawings in which.

As described hereinafter, the device in accordance with the invention comprises a heating cell provided with a gas-tight enclosure forming a vessel and heating means, a unit for the introduction of raw materials into the cell, a cooling chamber adapted to communicate with the cell via a duct having a siphon and a zone pierced with at least one vibrating orifice, first pneumatic means for establishing and controlling the pressure of the atmosphere within the enclosure, a vibrator connected to the zone which includes the vibrating orifice and adapted to produce continuous vibration of said orifice, second pneumatic means for establishing and controlling the pressure of the atmosphere contained within the cooling chamber, and a device for discharging solid material from said chamber.

Figure 1:
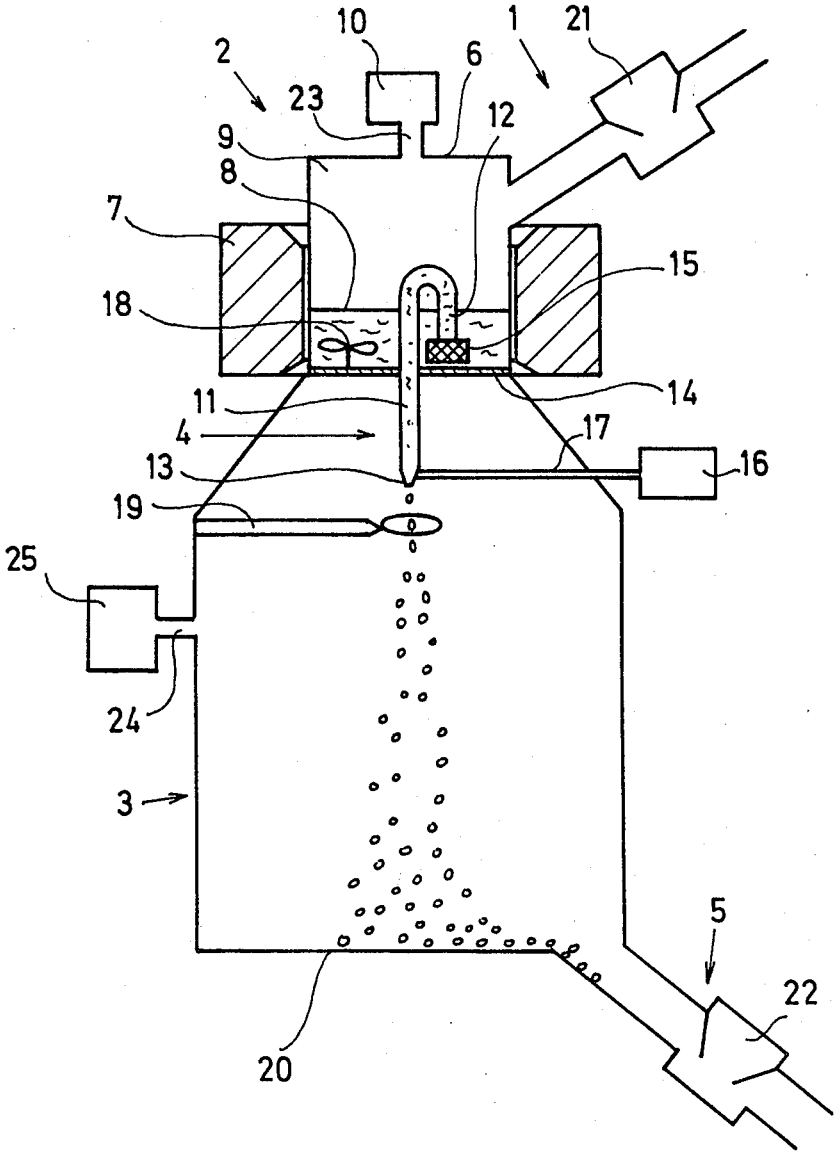
FIG. 1 is a diagrammatic sectional view of the different elements of the device in accordance with the invention in a first embodiment of said device.

Thus the device shown in FIG. 1 comprises a closable unit 1 for the introduction of material in order to convey the metal into a heating cell 2 from which the molten metal is injected into a cooling chamber or tower 3 via a duct 4. A closable discharge unit 5 serves to remove the solid metal granules formed within the cooling tower 3.

The heating cell 2 comprises a gas-tight enclosure 6 forming a vessel for containing the molten metal. Said enclosure 6 is heated by a furnace 7 which surrounds its side walls and serves to maintain within the enclosure a temperature which is higher than the melting point of the metal. The molten metal 8 occupies the lower portion of the enclosure 6 and a gaseous atmosphere 9 is present above said molten metal. The pressure of said atmosphere is controlled by a first pneumatic means 10 to which said atmosphere 9 is connected by means of a duct 23. Said pressure can be either increased or reduced so as to cause injection of the molten metal 8 through the duct 4 at a higher or lower rate.

Said duct is constituted by a U-shaped tube 11, one extremity 12 of which is immersed in the molten metal 8 and the other extremity 13 of which extends vertically within the upper portion of the cooling tower 3. The upper portion of the tube in the vicinity of the extremity 12 is bent so as to form a siphon, the elbowed portion of which projects above the level of molten metal. The extremity 12, the opening of which is directed towards the bottom end-wall 14 of the enclosure 6, is fitted with a filter 15 for retaining the impurities contained in the molten metal. That zone of the enclosure 6 which is located in the vicinity of the bottom end-wall 14 is a settling zone in which impurities having a higher density than the rest of the liquid are permitted to accumulate. It will be possible to place the filter directly above said molten-metal settling zone in order to prevent solid inclusions in suspension from causing rapid clogging of the filter. The heating cell 2 is also provided with mechanical stirring means represented diagrammatically by the impeller 18 for producing a stirring and homogenizing action on the liquid. The extremity 13 of the tube 11 terminates in at least one orifice for the injection of molten metal into the cooling tower 3. The threadlike flow of molten metal thus obtained forms a vertical downflow jet to which vibrations are applied in order to produce uniform drops of liquid. In accordance with one embodiment, the extremity 13 of the tube is subjected to vibrations by means of a vibrator 16 and a connecting device represented diagrammatically by the rod 17. The drops of molten metal formed at the extremity 13 of the duct 4 are dispersed within the cooling tower by dispersion means 19 consisting, for example, of an annular electrode which surrounds the jet and is electrically charged with respect to the extremity 13 of the tube 11, thus conferring on the drops electric charges which are all of the same sign. The liquid drops are dispersed and moved away from the vertical direction of the jet, then solidify before dropping to the bottom end-wall 20 of the cooling tower 3. Said tower contains a gaseous atmosphere which permits rapid cooling of the metal and is inert with respect to this latter. Different means such as gas-circulating means, for example, can be provided within the tower in order to ensure accelerated cooling of the metal. The rate of cooling of the drops may govern the nature of the phase of the solidified material and thus the quality of the product obtained. The use of a gas-tight cooling tower makes it possible to prevent any communication between its internal atmosphere and the surrounding air. The pressure of the gaseous atmosphere of the tower can be controlled by a second pneumatic means 25 to which the tower is connected by means of a pipe 24.

In accordance with one embodiment, the metal introduction unit 1 comprises a communication lock-chamber 21 and the discharge unit 5 comprises a lock-chamber 22 so as to permit continuous operation of the installation. The unit 1 for the supply of raw material serves to introduce into the heating cell either molten metal or metal in the solid state; in the latter event, melting takes place within the heating cell and the metal is injected into the cooling tower only when it is completely melted and in a homogeneous state. It is possible to treat metals which react with oxygen since the hermetically sealed assembly comprising the heating cell 6, the pressure control means 10 and 25, the communication duct 4 and the cooling tower 3 can be subjected to a controlled atmosphere of a gas which does not react with the metal.

The practical application of the invention by means of the device shown in FIG. 1 consists in introducing the metal into the heating enclosure 6 either in the solid form or in the liquid form via the lock-chamber 21, in maintaining the temperature of the metal slightly above its melting point by means of the heating means 7 and in homogenizing the molten mass either by agitation or by bubbling produced by the stirring means 18. When the molten mass is homogeneous, it is injected into the cooling tower 3 via the tube 11 and the vibrating orifice. Priming of the siphon is carried out, for example, by means of an overpressure of the order of 50 to 500 g/cm$^2$ within the enclosure 6, this overpressure being produced by the pneumatic device 10. During their downward fall, the drops thus formed are dispersed if the annular electrode of the dispersion means 19 is energized and are then cooled by the atmosphere of the tower until they form solid spherical granules. The rate of injection of the molten metal through the vibrating orifices is regulated by means of the gas-pressure difference between the atmosphere 9 which is present above said molten metal within the heating enclosure and the atmosphere of the tower 3. This controlled and regulated injection rate makes it possible to take into account the nature of the metal, the vibration frequency of the vibrating orifices and a number of different physical parameters of the molten metal such as its temperature. The pneumatic means 10 and 25 thus serve to establish, regulate and stop the flow of injected liquid metal. At the end of the operation, said pneumatic means also permit reversal of the pressure difference between the two enclosures 6 and 3, thus making it possible to clean the filter without any need to open the enclosure and to put this latter in contact with oxygen.

Homogenization of the molten mass can be carried out in different ways. If the inclusions are of sufficiently small size, it is possible to form a homogeneous suspension of these particles by making use of the stirring means 18 in order to produce effective agitation. On the contrary, if the inclusions are of large size and are liable to cause excessively rapid clogging of the filter and/or of the injection orifices, a settling or sedimentation operation is performed in the bottom portion of the enclosure 6. In order to make it possible in particular to facilitate cleaning of the enclosure after sedimentation, provision can be made for a substantially and/or partially conical bottom end-wall 14, the apex of the cone being directed downwards in order to produce an accumulation of sedimentation products within a removable container (not shown in the figure) which is placed at the lower end of the cone. The container can be withdrawn for removal of said sedimentation products. Transfer of the container can be facilitated by means of a relatively displaced, asymmetrical arrangement of the conical endwall 14 and/or of the communication duct 4 with respect to the enclosure 6 so as to permit vertical withdrawal of the container without coming up against the siphon or the filter 15.

Figure 2:
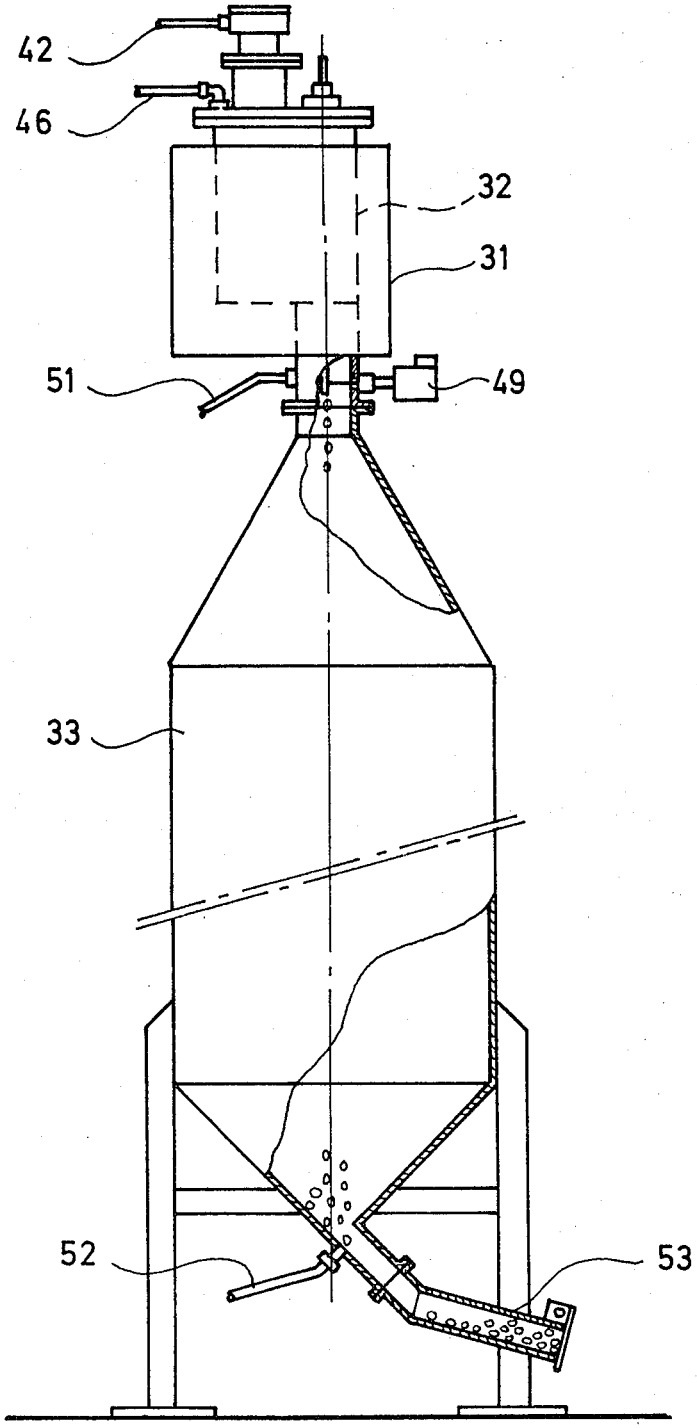
FIG. 2 is a vertical sectional view of a second embodiment of said device.
Figure 3:
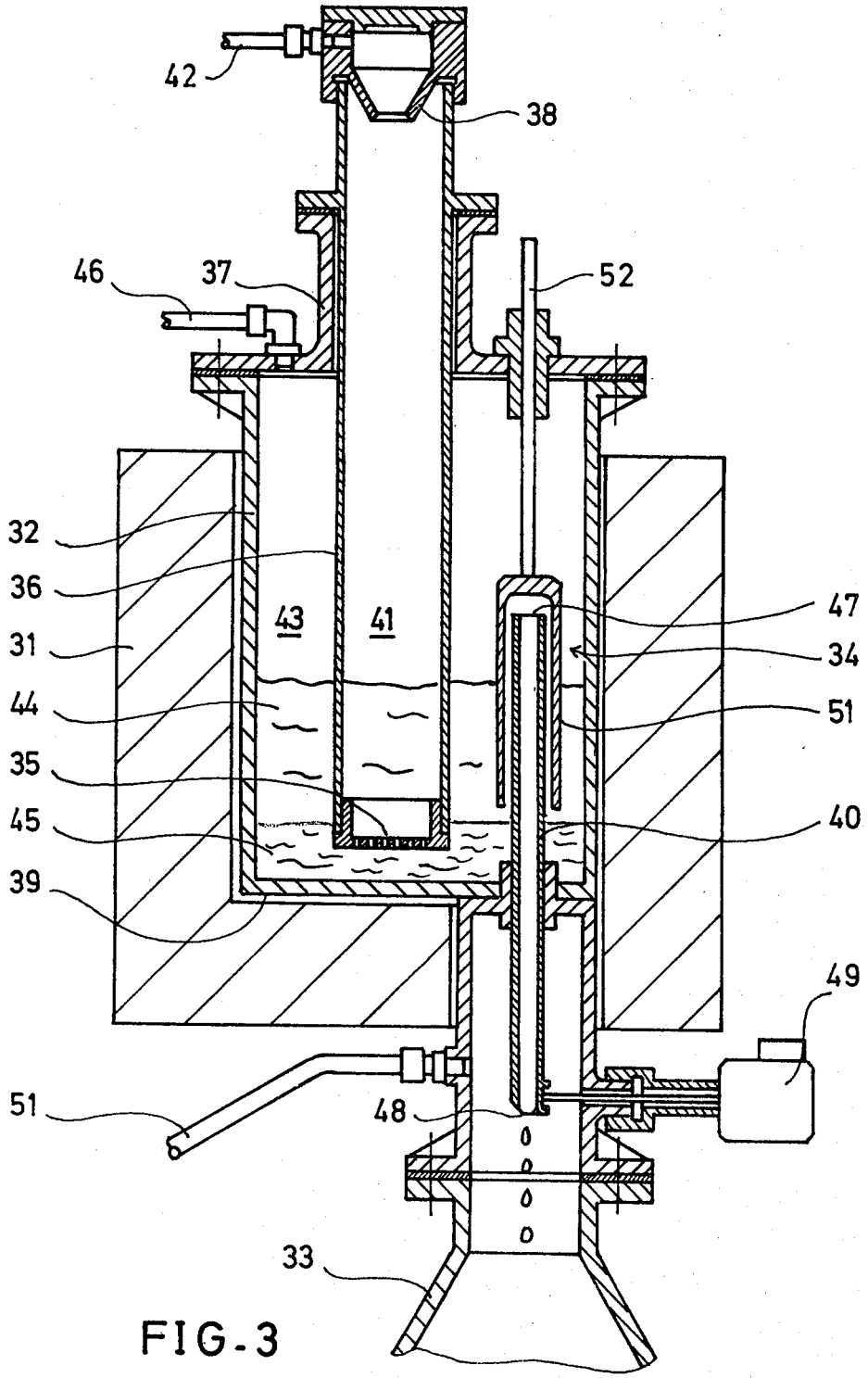
FIG. 3 is a more detailed view of the upper portion of the device of FIG. 2.

The device shown in FIGS. 2 and 3 is largely composed of the same essential elements as the device of the preceding embodiment but is so designed as to permit easier production of readily oxidizable reactive-metal granules. By means of this device, the metal which has already melted can in fact be purified immediately prior to formation of the jet and of the liquid drops by reacting with a fused-salt bath which is capable of dissolving the oxidation products and retaining them in said bath, thus preventing entrainment of solid inclusions in the liquid-metal jet and untimely solidifications at the time of formation of drops.

Accordingly, there is again shown in FIG. 2 a furnace 31 surrounding a gas-tight cell 32 mounted above a tower 33 which closes a gas-tight chamber, said chamber being separated from the cell 32. A communication between said chamber and said cell takes place only by means of a siphon 34 (as shown in FIG. 3).

The furnace 31 serves to heat the cell 32 so as to melt the materials which are introduced therein and to maintain these latter in the molten state, namely both the metal which is intended to constitute the granules produced and the metal halides which constitute the purification bath. The cell 32 is equipped so as to define within the interior of the furnace two separate compartments which communicate with each other through a filter 35. The construction shown in detail in FIG. 3 corresponds to the case in which the bath employed consists of purification salts having a higher density than the molten metal. A tubular shaft 36 placed vertically within the enclosure 32 extends in leak-tight manner through the cover 37 and opens to the exterior via a lock-chamber 38 for the loading of solid products. The filter 35 is placed across the lower end of the shaft 36 above the bottom end-wall 39 of the cell 32. A first compartment 41 is thus constituted by the internal space of the shaft 36. During operation, the metal is introduced in the form of solid lumps through the lock-chamber 38 and then subjected to the melting process. The metal is protected against oxidation by means of an inert gas which is admitted into said compartment at 42. The other compartment 43 is constituted by the intermediate space between the shaft 36 and the vessel which limits the cell 32. The design function of said compartment 43 is to permit separation by settling between the molten metal and the purification bath after the metal has passed through said bath. By means of said compartment 43, a mass of molten metal 44 from which a withdrawal will subsequently be made in order to form the liquid metal jet can thus be formed within the cell 32. In the case of the figure, the mass of liquid metal 44 settles above the fused-salt bath 45 and an inert gas atmosphere introduced into the cell 32 at 46 is present above said mass 44. The purification salt is present in sufficient quantity to ensure that the filter 35 always remains immersed in the bath 45. By modifying the inert-gas pressures at 42 and 46, liquids may be forced through the filter 35 either in order to cause transfer of the molten metal from the melting compartment 41 to the settling compartment 43 or to circulate the fused salt through the holes of the filter for cleaning purposes.

The constructional design of the means for withdrawing liquid metal, for forming the jet and for dividing said jet into drops is also apparent from the details illustrated in FIG. 3. The duct forming a siphon 34 comprises two coaxial vertical tubes which slide one inside the other. The inner tube 40 passes through the bottom end-wall 39 of the cell 32. The upper end of the inner tube opens at 47 into the inert gas atmosphere which is present above the mass of molten metal 44; the lower end of said inner tube extends vertically downwards within the top portion of the tower 33 and terminates in the vibrating orifice 48. There is shown at 49 a vibrator which produces action on the extremity of the tube 46 and thus causes division of the jet into liquid drops as soon as this latter passes out of the orifice 48. The outer tube 51 of the siphon is closed at its upper end and can be displaced from the exterior of the cell by means of a rod 52; when moved downwards to the full extent, its lower end opens at the level of the molten mass 44. The operation of said outer tube thus makes it possible to prime the siphon and to initiate the flow of liquid metal through the inner tube 46.

The jet of liquid metal divided into drops falls into the tower 33, said tower being filled with an inert gas which is admitted at 51 and withdrawn at 52 (as shown in FIG. 2). The internal atmosphere within the tower is cooled by heat dissipation in the surrounding air through the tower walls. The height of the tower is sufficient to ensure that the drops of liquid metal solidify completely while falling. The solid granules thus obtained are collected at the bottom of the tower 33 and extracted through a lock-chamber 53. The filter 35 which is intended to prevent the passage of any solid inclusion which would otherwise be liable to clog the vibrating orifice 48 is provided with holes which are smaller in size than the orifice or equal at a maximum to the size of said orifice. By way of example, the diameter of said holes can be smaller than 200 microns in the case of vibrating orifices having diameters which can vary between 200 microns and 3 mm.

With respect to the foregoing description, the device in accordance with the invention can be designed differently in other forms of embodiment. At the level of the melting furnace, for example, the shape of the shaft 36 and of the siphon 34 can be modified so as to adapt the cell 32 to receive a fused-salt bath having a density which is lower than that of the molten metal. Withdrawal of liquid metal accordingly takes place within the mass which settles beneath the fused-salt bath. Furthermore, the granule production yield can be increased in an industrial manufacture by replacing the single orifice 48 by a vibrating plate provided with holes which form separate jets. A series of jets can thus be formed in the same cooling atmosphere and at the end of the same withdrawal device. It is also possible to increase the number of devices for withdrawal by siphoning from the same mass of liquid metal and these different withdrawal devices may result in jets formed either in the same cooling tower or in different towers.

Examples of practical application of the invention in the production of different metallic granules will now be described. In the case of reactive metals, granulation is performed by employing a device of the type shown in FIGS. 2 and 3 with purification by a fused-salt bath. There is added in some cases a device for dispersion of metal drops such as the device described with reference to FIG. 1.

Depending on requirements, the purification bath employed consists either of a halide of the metal to be granulated, namely a fluoride or a chloride as a general rule, or a mixture of these salts, or a halide of a metal which has higher reducing power and the oxide of which is formed preferentially with respect to the oxide of the metal to be granulated. Consideration is given in particular to the requirement which consists in dissolving the oxides of calcium or lanthanum in their halides. To this end, calcium can be added to a metal such as aluminium or magnesium, for example, by employing a proportion of calcium which is sufficient to permit reduction of substantially the entire quantity of oxide which may be present in the metal to be granulated and to retain the oxides by reaction of the lime with a bath of calcium fluoride and/or chloride through which the molten metal mixture is passed.

For example, in the production of tin granules intended for use as soldering material, there is no important oxidation problem to be solved. However, the mass of molten metal within the melting cell has been protected by a blanket bath formed by the eutectic compound LiCl-KCl and heated together with this latter at 350° C. The cooling tower contained argon which had been introduced under normal conditions of temperature and pressure and the jet discharged from the vibrating orifice passed through an annular electrode brought to 5000 V. The granules thus obtained had a particle size spectrum of 1 mm ±0.01 mm.

Under similar conditions, a powder which was intended to be employed in aluminothermy was produced from molten aluminium heated to 850° C. by employing in addition a bath of fused cryolite ($Na_3AlF_6$) in order to dissolve the alumina. The molten aluminium has a higher density than said bath and is therefore drawn-off at the bottom of the cell. The cooling gas was helium.

In the case of magnesium, the fused-salt bath employed by way of example consists of a mixture of magnesium chloride and fluoride.

Calcium is widely employed for such purposes as refining cast-iron and steel, for example.

The invention makes it possible to utilize calcium in the form of a uniform powder of spherical granules which can readily be conveyed and added in predetermined proportions without incorporating undesirable constituents.

Starting from calcium which has been melted at 880° C., purified through a filter having a hole diameter of 0.2 mm, immersed in a bath of the eutectic mixture consisting of calcium chloride/fluoride (containing 13.76% by weight of calcium fluoride) and, after settling of the metal above said bath and forming the jet through a nozzle having a diameter of 0.4 mm and vibrated at 1500 c/s, then causing the drops to fall without dispersion into helium employed as a coolant gas, the powder finally obtained consisted of spherical grains having a smooth surface and a diameter within the range of 0.6 to 1.6 mm. The powder is reactive to air, oxygen and water only to a very slight extent.

The addition of magnesium to the calcium makes it possible to reduce the melting point of the alloy. From 11.5% by weight of magnesium in the alloy to the eutectic compound containing 28% by weight of magnesium, the temperature to be imposed on the molten alloy is in fact determined by the melting point of the salts: 645° C. in the case of the eutectic compound $CaCl_2$—$CaF_2$. The melting cell is therefore brought to a temperature of 700° C., for example.

In another example, the same bath of salts is employed in the field of granulation of aluminium. Calcium is then added to the solid aluminium which has been introduced, the quantity of calcium being at least stoichiometric for the reduction of the oxygen which it may contain, namely and by way of example 0.5% by weight of calcium in the case of commercial aluminium.

Under the same conditions but in the case of granulation of magnesium, a larger proportion of calcium was added, with the result that the greater part of the calcium was present in the magnesium produced in the form of granules, for example in a proportion of 8% by weight. In the case of an initial oxygen content of the order of 0.1%, only a proportion of the order of 0.25% of the metallic mixture is consumed in the salt bath, the necessary quantity of salts being approximately 50 g of bath per kilogramme of magnesium to be treated.

In all these examples, the frequency of vibrations imparted to the jet discharge orifice was 1500 c/s, but this frequency can be increased to 6000 c/s. Alternatively, any frequency within the range of 1000 to 16000 c/s may be employed. Furthermore, the height of fall within the coolant gas is chosen so as to be sufficient to ensure that complete solidification of the drops always takes place during the fall immediately upon discharge from the vibrating orifice in order to benefit by the effect produced on the drops by the vibration. The data given below have been used as a basis for evaluating the coolant gas temperature at 50° C. and the metal temperature at the vibrating orifice at 70° C. above the melting point:

| | | Maximum velocity | Height of solidification |
|---|---|---|---|
| Calcium in helium | | | |
| Diameter | 0.5 mm | 4.5 m/s | 15 cm |
| Diameter | 1 mm | 9.8 m/s | 85 cm |
| Diameter | 2 mm | 21.0 m/s | 4 m |
| Calcium in argon | | | |
| Diameter | 0.5 mm | 2 m/s | 0.4 m |
| Diameter | 1 mm | 4.7 m/s | 2 m |
| Diameter | 1.6 mm | 8 m/s | 5.6 m |
| Magnesium in helium | | | |
| Diameter | 0.5 mm | 4.8 m/s | 0.4 m |
| Diameter | 1 mm | 10.7 m/s | 2.2 m |
| Diameter | 2 mm | 23 m/s | 11 m |
| Ca 88.5% + Mg 11.5% in helium | | | |
| Diameter | 0.5 mm | 4.5 m/s | 0.25 m |
| Diameter | 1 mm | 10 m/s | 1.4 m |
| Diameter | 2 mm | 22 m/s | 7 m |
| Diameter | 2.5 mm | 28 m/s | 11.5 m |
| Aluminium in helium | | | |
| Diameter | 0.5 mm | 6.6 m/s | 0.9 m |
| Diameter | 1 mm | 15 m/s | 4.3 m |

As will readily be understood, the invention is not limited either to the description or to the examples given in the foregoing or to the accompanying drawings and any variant within the capacity of those versed in the art accordingly forms part of the present invention.

We claim:

1. A method of production of metallic granules in which the granules are formed by solidification from molten metal, comprising passing the molten metal in a divided state through a purification bath, collecting said molten metal into a mass, separating, said molten metal from said bath by settling, forming a jet of molten metal by withdrawal from said mass, passing said molten metal through a vibrating orifice in order to divide the jet into individual drops and solidfying said drops by cooling so as to form granules.

2. A method in accordance with claim 1, wherein the drops of the jet are caused to fall from the vibrating orifice in order to divide the jet into individual drops and solidifying said drops by cooling so as to form granules.

3. A method in accordance with claim 2 wherein during solidification a dispersion of the drops is also carried out with respect to the directions of fall of the jet.

4. A method in accordance with claim 1, wherein said purification bath is maintained in contact with said mass of molten metal and is constituted by a bath which is not miscible with the mass and selectively dissolves derivatives produced in the event of oxidation.

5. A method in accordance with claim 4, wherein the mass of molten metal is forced through a filter for retaining solid particles which is maintained immersed in said purification bath.

6. A method in accordance with claim 1, wherein the bath is constituted by a fused halide of at least one metal of said mass.

7. A method in accordance with claim 1, wherein the bath is constituted by a fused halide of an additional metal having higher reducing power than an essential metal of the granules and incorporated in said mass in a small proportion.

8. A method in accordance with claim 6, wherein said metal is calcium and said bath is constituted by calcium fluoride and/or calcium chloride.

9. A device for producing metallic granules comprising a heating means for melting metal, a vessel for receiving molten metal from said heating means, a purification bath disposed in said vessel, means for causing the molten metal to pass in the divided state through the purification bath, means for separating said mass from said bath by settling within said vessel, means for forming a jet of metal withdrawn from said mass through a vibrating orifice, means for causing vibration of said orifice and thus dividing the jet into individual drops, and a chamber for cooling and solidifying the metal discharge from said orifice over at least the distance of travel of the drops during the solidification of said drops.

10. A device in accordance with claim 9, further comprising a siphon for withdrawing molten metal from said mass of molten metal so as to form said jet.

11. A device in accordance with claim 10, further comprising a filter having holes smaller in size than the vibrating orifice or equal thereto at a maximum and means for forcing the molten metal through said filter which is immersed in said bath.

12. A device in accordance with claim 9 wherein said heating vessel is a furnace.

* * * * *